US007857549B1

(12) United States Patent
Deshazer

(10) Patent No.: US 7,857,549 B1
(45) Date of Patent: Dec. 28, 2010

(54) UNDERPINNING PILE ASSEMBLY FOR SUPPORTING A STRUCTURE UPON THE EARTH AND PROCESS FOR INSTALLING SUCH UNDERPINNING PILE ASSEMBLY

(75) Inventor: Henry Lee Deshazer, Houston, TX (US)

(73) Assignee: Cable Lock, Inc., Houston, TX (US)

( * ) Notice: Subject to any disclaimer, the term of this patent is extended or adjusted under 35 U.S.C. 154(b) by 0 days.

(21) Appl. No.: 12/429,914

(22) Filed: Apr. 24, 2009

(51) Int. Cl.
*E02D 5/30* (2006.01)

(52) U.S. Cl. ..... 405/250; 405/230

(58) Field of Classification Search ..... 405/229, 405/230, 231, 232, 250, 251, 252, 255
See application file for complete search history.

(56) References Cited

U.S. PATENT DOCUMENTS

| | | | | |
|---|---|---|---|---|
| 1,971,691 | A * | 8/1934 | Nadel | 405/250 |
| 2,428,070 | A * | 9/1947 | Frenkil | 405/250 |
| 2,558,529 | A * | 6/1951 | Thornley | 405/250 |
| 2,938,355 | A * | 5/1960 | Dougherty | 405/250 |
| 4,678,373 | A * | 7/1987 | Langenbach, Jr. | 405/230 |
| 4,695,203 | A * | 9/1987 | Gregory | 405/230 |
| 5,096,333 | A * | 3/1992 | Bassett | 405/252 |
| 5,145,291 | A * | 9/1992 | Bullivant | 405/230 |
| 5,234,287 | A * | 8/1993 | Rippe, Jr. | 405/230 |
| 5,399,055 | A * | 3/1995 | Dutton, Jr. | 405/230 |
| 6,179,526 | B1 * | 1/2001 | Knight et al. | 405/232 |
| 6,183,167 | B1 * | 2/2001 | Ruiz et al. | 405/230 |
| 6,200,070 | B1 * | 3/2001 | Knight | 405/232 |
| 6,264,402 | B1 * | 7/2001 | Vickars et al. | 405/251 |
| 6,309,143 | B1 * | 10/2001 | Merjan et al. | 405/251 |
| 6,514,012 | B2 * | 2/2003 | Gregory et al. | 405/230 |
| 6,718,648 | B1 * | 4/2004 | Knight | 33/755 |
| 6,799,924 | B1 * | 10/2004 | Kight et al. | 405/251 |
| 6,951,437 | B2 * | 10/2005 | Hall | 405/230 |
| 7,037,045 | B2 * | 5/2006 | Jones | 405/251 |
| 7,108,458 | B1 * | 9/2006 | Davie et al. | 405/230 |
| 7,416,367 | B2 * | 8/2008 | St. Onge et al. | 405/230 |
| 2004/0141814 | A1 * | 7/2004 | Covington | 405/230 |
| 2005/0031418 | A1 * | 2/2005 | Whitsett | 405/251 |
| 2005/0111920 | A1 * | 5/2005 | Kight et al. | 405/232 |
| 2005/0141969 | A1 * | 6/2005 | Gregory et al. | 405/230 |
| 2007/0000187 | A1 * | 1/2007 | St. Onge et al. | 52/157 |

FOREIGN PATENT DOCUMENTS

GB 2162224 A * 1/1986

* cited by examiner

*Primary Examiner*—Frederick L Lagman
(74) *Attorney, Agent, or Firm*—Egbert Law Offices PLLC

(57) ABSTRACT

An underpinning pile assembly for supporting a structure upon the earth has at least one steel pipe, at least one concrete pile segment positioned above the steel pipe, and a transition member interposed between the steel pipe and the concrete pile such that the load of the concrete pile is supported by the steel pipe. The steel pipe includes a plurality of steel pipe segments extending in end-to-end relationship in generally vertical alignment. A key member is received in slots formed in the respective ends of the first and second segments. The plurality of concrete pile segments includes a strand affixed in holes formed through the plurality of concrete pile segments.

16 Claims, 2 Drawing Sheets

UNDERPINNING PILE ASSEMBLY FOR SUPPORTING A STRUCTURE UPON THE EARTH AND PROCESS FOR INSTALLING SUCH UNDERPINNING PILE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the repair of building foundations by underpinning. Additionally, the present invention relates to underpinning pile assemblies having both concrete piles and steel pipes.

2. Description of Related Art Including Information Disclosed Under 37 CFR 1.97 and 37 CFR 1.98

There is a type of precast concrete pile used in the underpinning of building foundations comprised of vertically stacked, unconnected, precast concrete segments. These segments are pressed or driven vertically into the soil one at a time until adequate load capacity is obtained. This type of pile is distinctive in that it can be installed with almost no clearance, usually beneath an existing structure.

Although serviceable, this pile has several significant disadvantages: (a) the pile segments are not aligned, other than being stacked on each other, and detrimental misalignments can occur, (b) independent inspection of the installed pile depth is only possible by providing full-time inspection personnel during installation to monitor the quantity of pile segments used at each pile location, and (c) the complete pile is an unreinforced stack of precast concrete segments.

Misalignment of the segments as they are installed can produce several conditions detrimental to the future pile stability. Lack of proper independent inspection of pile depth can lead to inadequate pile penetration, which in highly expansive soils produces an unstable installation subject to continued movements caused by seasonal change in soil moisture content. An unreinforced or non-continuously reinforced pile is subject to permanent separation at segment joints or breakage at segment midpoints when installed in clay soils having high shrink-swell potentials.

In the past, various patents have issued relating to the devices for installing underpinning piles retroactively for the support of a structure. For example, U.S. Pat. No. 5,288,175, issued on Feb. 22, 1994 to D. W. Knight, describes a continuously reinforced segmental precast concrete underpinning pile. A method of installing the underpinning pile is used where a high-strength strand aligns the precast segments during installation. The strand provides a means for measurement of the pile penetration depth. The strand continuously reinforces the pile when bonded or anchored upon completion. This patent describes a further process whereby a strand is affixed to a first pile segment prior to being driven into the earth. The first pile segment, along with the attached strand, is driven a desired distance into the earth from the supporting structure. The strand will extend upwardly and outwardly from an end of the first pile segment. The second pile segment then slides along the strand until the second pile segment contacts an end of the first pile segment. The second pile segment is then driven into the earth for a desired distance. Ultimately, after each of the pile segments is driven a desired distance into the earth, a cap member is affixed to the top of the array of pile segments so as to be placed under the foundation of the structure. In "chicken pot pie" type soil conditions, where a softer layer of earth is located between a stiff crust and a denser, lower layer, the method of this patent fails to utilize existing pile structures. As such, there is a considerable cost associated with the driving of multiple pile segments through the softer layer of the earth. With such soil structures, it would be desirable to use the existing pile structures if possible.

U.S. Pat. No. 5,399,055, issued on Mar. 25, 1995 to E. T. Dutton, Jr., teaches a device and method to level and repair a failed concrete foundation. A series of cylindrical pile segments are jacked into the soil to a pre-determined depth so as to attain sufficient skin friction. Water jetting is utilized during the jacking process to loosen and remove soil. Reinforcing steel is inserted into the stacked column of cylindrical pile segments and grout is further pumped into the cylindrical pile segments to suitably fix the reinforcing steel to the inside of the cylindrical piles. This forms a single shaft pile so as to eliminate or reduce pile deflection and shear. Once again, the patent fails to make use of existing timber piles.

U.S. Pat. No. 5,713,701, issued on Feb. 3, 1998 to F. S. Marshall, describes a foundation piling which has a metallic piling sleeve member filled with solidified or cured cementitious material and a hollow, cylindrical outer sleeve member having a diameter larger than that of the metallic sleeve member. The outer sleeve member is placed generally concentrically around the piling sleeve member. The piling and the outer sleeve member are vertically driven into the soil. Further metallic piling sleeves and outer sleeve members are successively vertically driven into the soil until the piling is complete and the metallic piling sleeve and outer sleeve members abut one another in vertical relation.

U.S. Pat. No. 6,179,526, issued on Jan. 30, 2001 to Knight et al., shows a method of forming a pile isolation void. This method includes the steps of forming a foundation pile having an enlarged cross-section within a specific localized section, and driving the foundation pile a desired distance into the earth so as to form a pile isolation void directly above the enlarged cross-section. The enlarged cross-section can be located at the bottom of the foundation pile or along the length of the foundation pile. The pile isolation void is an annular void extending around the foundation pile above the enlarged cross-section. This pile isolation void can be filled with a material, such as liquid, gel, or a solid material different than the material of the pile or of the earth.

U.S. Pat. No. 6,200,070, issued on Mar. 13, 2001 to D. W. Knight, shows process of installing piles for supporting a structure upon the earth. This process includes the steps of forming a receptacle in a first pile segment, affixing an end of a strand into the receptacle such that the strand extends outwardly from the first pile segment, sliding a second pile segment onto the strand until the second pile segment contacts a surface of the first pile segment, and driving the second pile segment a desired distance into the earth. The receptacle is formed in the first pile segment while the first pile segment is in the earth.

U.S. Pat. No. 6,543,967, issued on Apr. 8, 2003 to F. S. Marshall, shows a staggered rebar design for concrete pilings. A first pile segment is driven into the earth. Two support rods of varying length are positioned and grouted into a passage running through the segment. The first support rod is one-half of the height of the pile segment, while the second is one and one-half times the height of the pile segment. An additional pile segment is driven on top of the first segment. Support rods which are twice the height of a single segment are positioned and grouted into the passage.

U.S. Pat. No. 6,634,830, issued on Oct. 21, 2003 to F. S. Marshall, describes a method and apparatus for post-tensioning segmented concrete pilings. A cable anchor serves as a base segment for multiple concrete piling segments. After installing all the concrete segments on top of the base segment, a cable is inserted into passages in the segments. The cable is threaded through the completely installed piling segments and into the cable anchor. After the cable bottoms out in the cable anchor, upward tension is applied to the cable. As the cable is pulled, cable lock members in the cable anchor increase gripping pressure as the cable tension increases so as to solidly anchor the end of the cable in the cable anchor.

U.S. Pat. No. 6,718,648, issued on Apr. 13, 2004 to T. S. Knight, shows a method of measuring a length of a pile which supports a structure upon the earth. This method includes the steps of affixing a flexible strand to a first pile segment, driving the first pile segment a desired distance into the earth such that the flexible strand extends along the length of the first pile segment along an exterior surface thereof, and driving a plurality of additional pile segments into the earth such that the pile segments reside upon an end of the first pile segment. The flexible strand extends along a length of the plurality of additional pile segments on the exterior surface thereof.

U.S. Pat. No. 6,722,820, issued on Apr. 20, 2004 to F. S. Marshall, provides a method of installing grout within a piling. Pile segments are driven into the ground on top of each other so as to form a piling. A single piling passageway is formed when the pile segments are in alignment. An alignment securing assembly is placed in the passageway. Vibrations are sent through the piling so that grout will not gather in the upper portions of the passageway before the lower portions of the passageway are filled with grout. The alignment securing assembly uses an anchoring device that is lowered and set in the passageway so that tension can be applied by a cable.

U.S. Pat. No. 6,763,636, issued on Jul. 20, 2004 to M. Dimitrijevic, provides a method and apparatus for lifting and leveling an existing building. At least a first non-cylindrical support section and a second support section are coupled together by a fastening device. A jack is used to raise the foundation of the existing building to a desired height. The apparatus is attached to the foundation of the building from underneath the building or from a location adjacent a side of the building.

U.S. Pat. No. 6,799,924, issued on Oct. 5, 2004 to Kight et al., describes a segmented concrete piling assembly with steel connecting rods. A first starter pile segment is driven into the soil adjacent the structure. A connecting rod is inserted into the upper end of the starter pile segment. A second or follower pile segment is placed on the upper end of the starter pile segment, over the connecting rod, and driven into the soil. This further drives the starter pile segment into the soil.

U.S. Pat. No. 6,881,012, issued on Apr. 19, 2005 to G. R. Covington, teaches a foundation repair system and method of installation. This system has continuously interlocked segmental precast concrete underpinning piles. A cooperating extension on one segment engages a cooperating depression on an adjacent segment. This aligns the precast segments during installation so as to provide a laterally stable pile.

U.S. Pat. No. 6,951,437, issued on Oct. 4, 2005 to D. B. Hall, provides a building foundation support and repair system. The system has a column of generally cylindrical pile sections driven into the earth below the edge of the foundation, and has an earth-penetrating bit attached to the lowermost pile section. The earth-penetrating bit includes a center post member extending within a bore in the lowermost pile section and/or a sidewall journaling the lower end of the lowermost pile section. The bit is connected to an elongated rod extending through the series of connected pile segments and is used to drive the bit rotatably during installation of the pile sections. This minimizes lateral excursion of the support system during and after installation of the column of pile sections.

U.S. Pat. No. 7,108,458, issued on Sep. 19, 2006 to Davie, Jr. et al., discloses a method and apparatus for repairing building foundations by segmented underpinning In particular, there are a plurality of pile segments that are reinforced in a longitudinal direction. A precast starter segment has a coil embedded in one end of the segment and a coil rod protruding from the other end. The starter segment is driven into the earth with its protruding rod end facing downwardly. A second segment is interlocked with the first by threading the second segment's rod and into the coil of the starter segment. The second segment is screwed into the first segment until the two segments lock together.

U.S. Pat. No. 7,195,426, issued on Mar. 27, 2007 to D. May, provides a structural pier and method for installing the pier. The pier includes a pier shaft, a bracket mounted to a top end of the pier shaft that supports the weight of the foundation, and a pair of braces that extend laterally from the pier shaft and mount to the foundation.

U.S. Pat. No. 7,429,149, issued on Sep. 30, 2008 to Price et al., provides a sleeved, segmented support product for supporting a foundation. This product comprises support segments that can be assembled together into a variable-length pile. The segments assemble together telescopically so that adjacent segments are held in coaxial relation and resist radial misalignment that can reduce the load-bearing capacity of the support product.

U.S. Patent Publication No. 2008/0317556, published on Dec. 25, 2008 to M. Price, describes a pier system for supporting a building. The pier system includes a plurality of swaged pier segments in which each swaged pier segment is operable to be connected to another of the swaged pier segment. A hinged lifting platform is secured to an uppermost one of the swaged pier segments. At least one intermediate swaged pier segment is connected to the uppermost swaged pier segment. An encasement is provided for partial receipt of the intermediate swaged pier segment.

One of the problems associated with these prior art underpinning pile assemblies is the use of concrete pile segments. In certain earth formations, it becomes very difficult to drive these pile segments the proper and desired distance into the earth. In particular, when the earth is particularly hard or dense, great forces would be required so as to cause the pile segments to reach their intended depth. As such, it would be desirable to provide an underpinning pile assembly which allows the underpinning piles to reach the proper and desired depth in a simple, convenient and efficient manner.

In those prior art patents that utilize steel sleeves or other steel systems, the steel members are generally positioned adjacent to the building foundation. As such, the steel members are driven into the earth in an area that is exposed to oxygen and moisture. Over time, these steel members can become corroded and deteriorate to the point that they are no longer effective and no longer adequately supporting the steel structure. As such, a need has developed so as to provide an underpinning pile assembly in which any steel components are effectively positioned so as to minimize exposure to moisture and oxygen.

Steel underpinning pile systems are often affixed to the foundation and driven at an angle into to the earth in a location below the foundation. This can create a great deal of torque onto the beam of the foundation and onto the steel pier. As such, a need has developed so as to provide an underpinning pile assembly which avoids the affects of the torquing of the beam and the steel pier.

It is an object of the present invention to provide an underpinning pile assembly which facilitates the ability to install the underpinning pile assembly to greater depths.

It is a further object of the present invention to provide an underpinning pile assembly which allows the assembly to be introduced into dense, hard, or compacted soils in a convenient and efficient manner.

It is a further object of the present invention to provide an underpinning pile assembly which effectively reduces the effective moisture and oxygen upon the steel member employed in the underpinning pile assembly.

It is a further object of the present invention to provide an underpinning pile assembly which eliminates the torquing of the beam of the foundation or the torquing of the steel members used in the underpinning pile system.

These and other objects and advantages of the present invention will become apparent from a reading of the attached specification and appended claims.

BRIEF SUMMARY OF THE INVENTION

The present invention is an underpinning pile assembly for supporting a structure upon the earth comprising at least one steel pipe, at least one concrete pile segment positioned above the steel pipe, and a transition member interposed between the steel pipe and the concrete pile such that the load of the concrete pile is supported by the steel pipe.

In the present invention, the steel pipe includes a plurality of steel pipe segments extending in end-to-end relationship in generally vertical alignment. In particular, this includes a first steel pipe segment, a second steel pipe segment, and a key member engaged in the first and second steel pipe segments. The first steel pipe segment has a slot formed at an end thereof. The second steel pipe segment has a slot formed at an end thereof. The key member is received in the slots of the first and second steel pipe segments. The key is freely received in the slots of the pipe segments such that the end of the first steel pipe segment abuts the end of second steel pipe segment.

The transition member of the present invention includes a collar which receives the steel pipe therein and a flange affixed to an end of the collar. The concrete pile segment has an end abutting a surface of the flange opposite the collar.

The concrete pile segment of the present invention includes a plurality of concrete pile segments extending vertically in end-to-end relationship. In particular, the plurality of concrete pile segments includes a first concrete pile segment having a hole extending longitudinally therethrough, a second concrete pile segment having a hole extending longitudinally therethrough, and a strand affixed in the holes of the first and second concrete pile segments. An adhesive is received in the holes of the concrete pile segments so as to fix the strand in each of the first and second concrete pile segments. In the preferred embodiment of the present invention, the concrete pile segment has a length of approximately 12 inches and a diameter of 6 inches. The steel pipe has a length of approximately 12 inches and a diameter less than the diameter of the concrete pile segment.

The present invention is also a process of installing piles for supporting a structure upon the earth. This process includes the steps of: (1) driving a steel pipe into the earth a desired distance from the structure; (2) positioning a concrete pile upon an end of the steel pipe; (3) and driving the concrete pile segment into the earth for a desired distance from the structure so as to correspondingly drive the steel pipe further into the earth.

In this process, the step of positioning includes placing a transition member onto the end of the steel pipe and positioning a lowermost end of the concrete pile segment against a surface of the transition member. The step of driving the steel pipe includes driving a first steel pipe into the earth a desired distance from the structure, inserting a key member into a slot on an end of the first steel pipe, inserting the key member into a slot in an end of a second steel pipe, and driving the second steel pipe into the earth a desired distance from the structure so as to correspondingly drive the first steel pipe segment further into the earth. The step of driving the concrete pile segment includes affixing a strand in a hole formed in the first concrete pile segment, sliding a second concrete pile segment along the strand such that an end of the first concrete pile segment abuts an end of the first concrete pile segment, and driving the second concrete pile segment into the earth a desired distance from the structure.

DETAILED DESCRIPTION OF THE INVENTION

Figure 1:
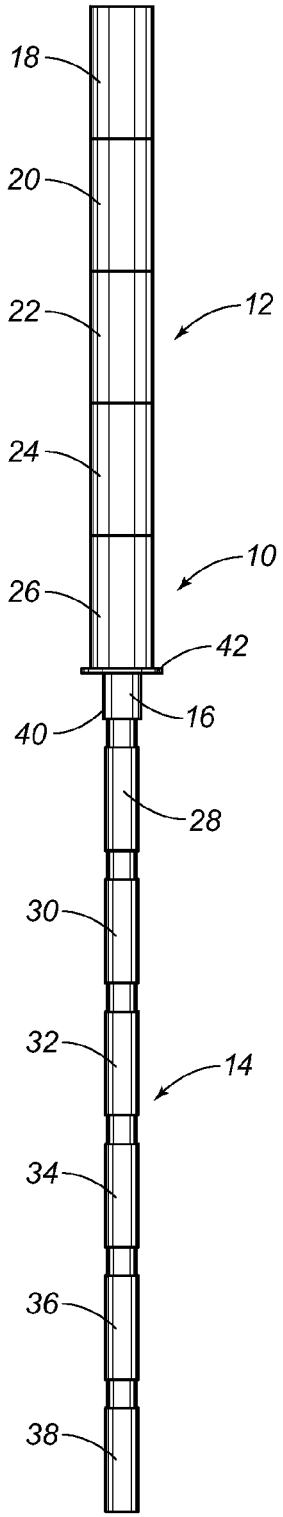
FIG. 1 is a side elevational view showing the underpinning pile assembly in accordance with the teachings of the preferred embodiment of the present invention.

Referring to FIG. 1, there is shown the underpinning pile assembly 10 in accordance with the teachings of the present invention. The underpinning pile assembly 10 includes a plurality of concrete pile segments 12 and a plurality of steel pipe segments 14. A transition member 16 is interposed between the steel pipe segments 14 and the concrete pile segments 12. The transition member 16 is positioned so that the load of the concrete pile segments 12 is supported by the steel pipe segments 14. Use of the transition member 16 prevents detrimental point loading of the concrete pile segments 12 against the steel pipe segments 14.

In FIG. 1, it can be seen that the plurality of concrete pile segments 12 includes pile segments 18, 20, 22, 24 and 26. The piles segments 18, 20, 22, 24 and 26 are stacked in end-to-end relationship in generally vertical alignment. As will be described hereinafter, a strand can extend through a hole formed in the interior of the concrete pile segments 12 so as to join the pile segments 18, 20, 22, 24 and 26 in vertical alignment and to serve to prevent any misalignment of the pile segments.

The plurality of steel pipe segments 14 includes steel pipe segments 28, 30, 32, 34, 36 and 38. Each of the steel pipe segments 28, 30, 32, 34, 36 and 38 are stacked in end-to-end relationship in vertical alignment. As will be described hereinafter, a key member can be utilized in association with each of the plurality of steel pipe segments 14 so as to assure the vertical alignment of such steel pipe segments. The number of concrete pile segments 12 and the number of steel pipe segments 14 can be selected based upon the desired structure required for the underpinning pile assembly 10, and for the desired depth of penetration into the earth.

In FIG. 1, it can be seen that the transition member 16 includes a collar 40 having a flange 42 affixed to one end of the collar 40. The lowermost concrete pile segment 26 abuts the surface of the flange 42 opposite the collar 40. The collar 40 is configured so as to receive the uppermost end of the steel pipe segment 28.

Figure 2:
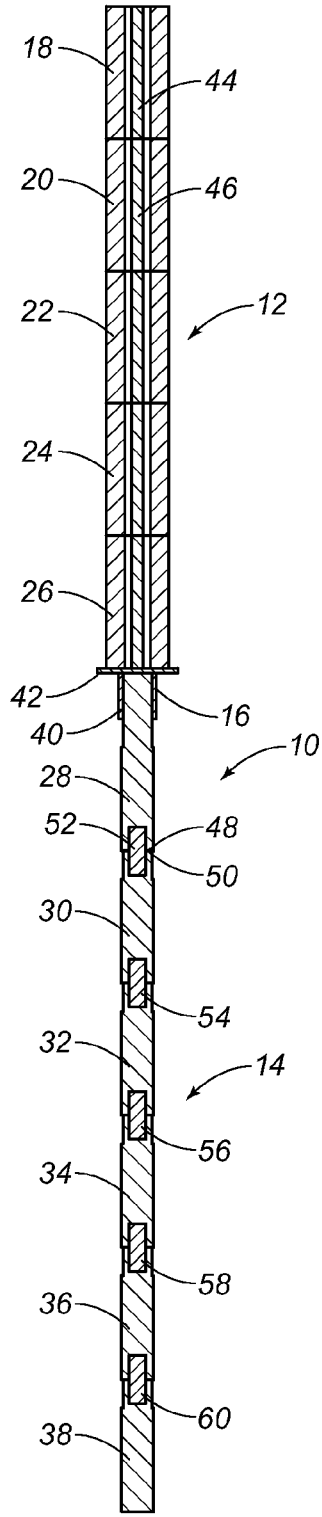
FIG. 2 is a cross-sectional view of the underpinning pile assembly in accordance with the preferred embodiment of the present invention.

FIG. 2 is a cross-sectional view of the underpinning pile assembly 10 of the present invention. It can be seen that the plurality of concrete pile segments 12 has a hole 44 extending longitudinally therethrough. In particular, the hole 44 will extend through each of the pile segments 18, 20, 22, 24 and 26. A steel strand 46 will extend through the hole 44. An adhesive or grout material can be introduced into the hole 44 so as to solidly fix the strand 46 within each of the pile segments 18, 20, 22, 24 and 26. As such, the steel strand 46 will serve to maintain the proper vertical alignment of the plurality of concrete pile segments 12. The grout or adhesive material within the hole 44 will serve to prevent oxygen and moisture from corroding the steel strand 46. The arrangement of the steel strand 46 within the hole 44 of the plurality of concrete segments 12 was described in the prior art in greater detail in U.S. Pat. No. 5,288,178.

In FIG. 2 it can be seen that the transition member 16 has the flange surface 42 abutting the lowermost end of the concrete pile segment 26. The collar 40 of the transition member 16 receives the uppermost end of the steel pipe segment 28 therein.

Importantly, in FIG. 2, it can be seen that each of the steel pipe segments 28, 30, 32, 34, 36 and 38 are joined together by a suitable key member. In particular, steel pipe segment 28 has a slot formed at the lower end 48 thereof. Similarly, the steel pipe segment 30 as a slot formed at the upper end 50 thereof. The key member 52 is received within the slots at the lower end 48 and the upper end 50 so as to fix the position of the steel pipe segment 28 in vertical alignment with the steel pipe segment 30. Key members 54, 56, 58 and 60 are used to respectively join the pipe segments 30, 32, 34, 34 and 38 together. The use of the key members within the slots assures the proper vertical alignment of the entire assembly of the plurality of steel pipe segments 14.

As used herein, the steel pipe segments 28, 30, 32, 34, 36 and 38 can be solid pipes joined in end-to-end relationship or tubular pipes. In the case of tubular pipes, the respective slots will be in the nature of a shoulder formed within the wall of such a tubular pipe. The key members 52, 54, 56, 58 and 60 can be of any cross-sectional configuration. Alternatively, the pipe segments 28, 30, 32, 34, 36 and 38 can be joined in end-to-end relationship by properly affixed sleeves around the outer diameter of each of the pipe segments. Still further, an upset can be formed so as to receive a pin connector of an adjacent pipe segment. As such, within the present invention, various techniques are envisioned whereby one pipe segment can be joined to another.

Since the load placed upon the plurality of steel pipe segments 14 extends vertically downwardly, it is not important that the key members be fixedly received within the pipe segments. The key members can be freely received within the slots, and the pipe segments can be freely placed upon the key members. The plurality of pipe segments 14 are intended to be driven downwardly into the earth. The free connection between the pipe segments and the key member allows proper vertical alignment and connections to be achieved without the need for additional steps, such as the application of adhesives, welding, threading, or other techniques that would slow the process of installation.

Figure 3:
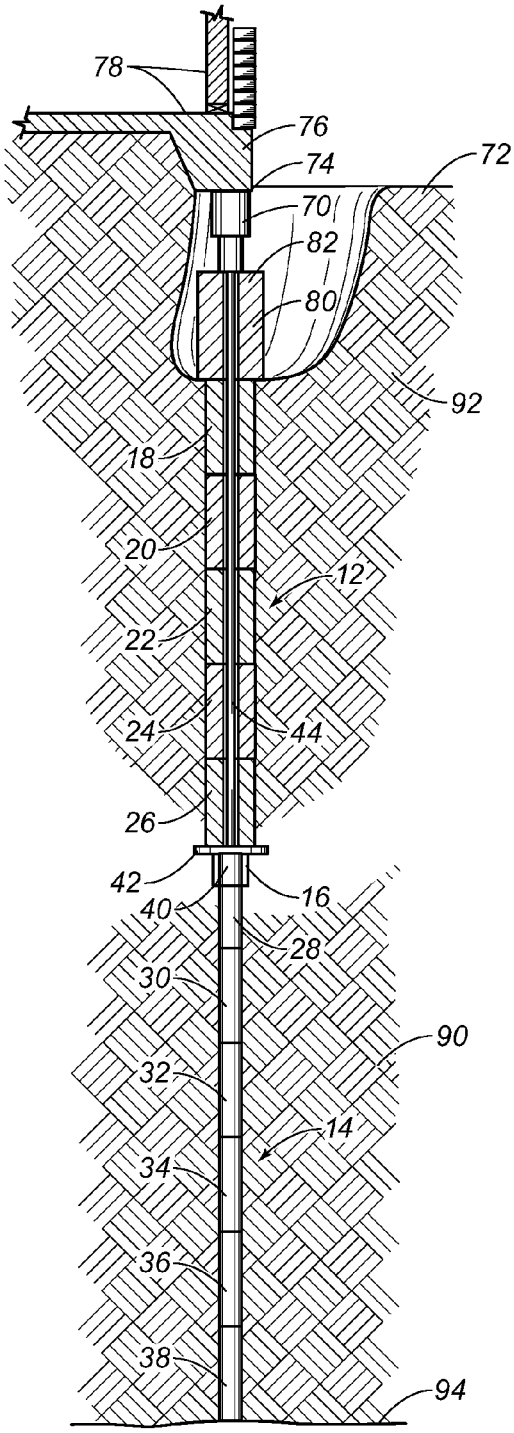
FIG. 3 is a partially cross-sectional side elevational view showing the underpinning pile assembly as installed into the earth.

FIG. 3 shows the assembled pile structure. In FIG. 3, it can be seen that a hydraulic jack 70 is used to drive the plurality of steel pipe segments 14 and the plurality of concrete pile segments 12 into the earth 72. The steel pipe segment 38 will be first driven a desired distance into the earth 72 from the bottom 74 of the foundation 76 of the structure 78. Once the steel pipe segment 38 is driven into the earth for a desired distance, the key member 60 (as shown in FIG. 2) can be inserted into the slot in the uppermost end of the steel pipe segment 38. The steel pipe segment 36 can then be placed onto the key member 60 by introducing the key member into the slot formed into the lowermost end of the steel pipe segment 36. The hydraulic jack 70 can then be used so as to drive the steel pipe segment 36, along with the connected steel pipe segment 38, a further desired distance into the earth. In a sequential manner, the various other steel pipe segments 34, 32, 30 and 28, along with their associated key members, are driven into the earth 15. When the uppermost steel pipe segment 28 has been introduced into the earth 72, the transition member 16 can then be placed thereon.

The concrete pile segment 26, along with the attached strand 44 is placed on the flange 42 of the transition member 16. The hydraulic jack 70 can then drive the concrete pile segment 26 a desired distance into the earth so as to push the plurality of steel pipe segments 14 further into the earth. The concrete pile segment 24 can then slide along the strand 44 so as to be positioned directly above the concrete pile segment 26. The hydraulic jack 70 is ultimately used so as to drive the concrete pile segment 24, and sequentially drive the concrete pile segments 22, 20 and 18 into the earth. Ultimately, after the steel pipe segments 30, 32, 34, 36 and 38, along with the concrete pile segments 18, 20, 22, 24 and 26 have been installed, a cap member 80 is installed on the uppermost end of the pipe segment 18. The end of the strand 44 is anchored in the cap member 80 adjacent to the top 82 of the cap member 80. If necessary, the strand 44 can be suitably tensioned prior to being anchored in the cap member 80. The hydraulic jack 70 can then be removed so that the bottom 74 of the foundation 76 will reside on the top surface 82 of the cap member 80.

In the illustration of FIG. 3, it can be seen that the plurality of steel pipe segments 14 reside in a lower earth formation 90. It is important to note that this lower earth formation 90 resides rather deeply within the earth 72. This location of the plurality of steel pipe segments 14 is relatively impervious to the passage of oxygen and moisture therethrough. Most of the oxygen and moisture that would otherwise affect the plurality of steel pipe segments 14 will be in the upper earth formation 92. In the present invention, by placing the plurality of steel pipe segments 14 deeply into the earth, the problems associated with rust and corrosion are effectively avoided. As such, the plurality of steel pipe segments 14 will maintain their strength and integrity for a very long period of time.

Also, in FIG. 3, the plurality of steel pipe segments 14 are driven into the earth a distance such that the lowermost steel pipe segment 38 resides upon a rock formation 94. In those circumstances where a rock formation 94 is located a distance below the earth, the plurality of steel pipe segments 14 can be driven into the earth for a suitable distance until contact with the rock formation 94 is achieved. As such, because of the contact between the plurality of steel pipe segments 14 and the rock formation 94, a very sturdy and stable structure of the underpinning pile assembly 10 for the support of the foundation 76 of building 78 is effectively achieved.

In other circumstances, where there is no rock formation 94, the plurality of steel pipe segments 14 acts as a friction pier because of the strong friction forces achieved by the highly compacted and dense soil structures in the lower earth formation 90. It is relatively easy to pass the plurality of steel pipe segments 14 through this dense and compact lower earth formation 90 because of the relatively narrow diameter structure of the plurality of steel pipe segments 14 and because of the relative strength of the steel pipe segments 14.

In the preferred embodiment of the present invention, the steel pipe segments 14 will have a length of approximately 12 inches and a diameter that is less than a diameter of each of the plurality of concrete pile segments 12. In particular, these diameters can be 2 inches, 2⅜ inches or 2⅞ inches. The concrete pile segments 12 will each have a length of approximately 12 inches and a diameter of 6 inches. It should be noted, however, that this is merely a description of the preferred embodiment of the present invention. Various other lengths and diameters can be utilized so as to achieve the beneficial effects of the present invention.

Since the underpinning pile assembly 10 resides directly below the foundation 76 of building 78, there will be no torquing of the beam of the foundation 76 or of the plurality of steel pipe segments 14. The load is directed vertically downwardly through the plurality of concrete pile segments 12 and the plurality of steel pipe segments 14.

Figure 4:
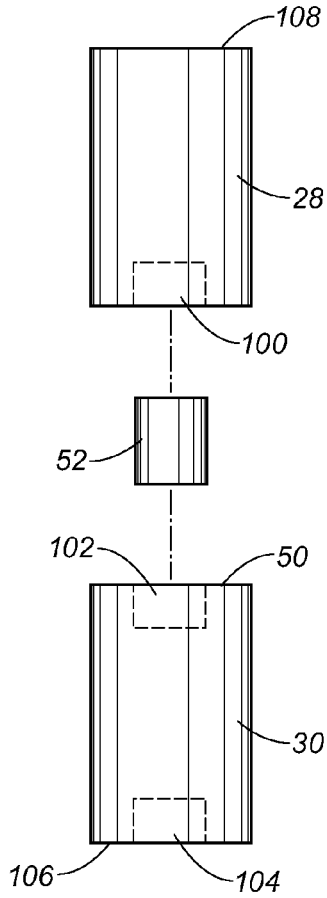
FIG. 4 is an exploded view illustrating the manner in which one steel pipe segment is keyed with an adjacent steel pipe segment.

FIG. 4 illustrates the manner in which the representative steel pipe segments 28 and 30 are joined together by the key member 52. In particular, the steel pipe segment 28 has a slot 100 formed at the bottom surface 48 thereof. The steel pipe segment 30 has a slot 102 formed at the upper surface 50 thereof. The key member 52 has a size and shape that will matingly fit into the slots 100 and 102. As such, the lower surface 48 will directly abut the top surface 50 while the key member 52 is received in the slots 100 and 102. As such, the key member 52 effectively avoids a shifting of the steel pipe member 28 with respect to the steel pipe member 30. This ensures proper vertical alignment of the steel pipe segments 28 and 30. All of the compressive forces between the pipe segments 28 and 30 are passed through the respective flat surfaces 48 and 50.

FIG. 4 further shows that another slot 104 is formed on the bottom surface 106 of the pipe segment 30. This allows the pipe segment 30 to be properly joined, in the same manner, to an underlying pipe segment. Within the present invention, the pipe segment 28 can also include a slot formed in a top surface 108 thereof.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An underpinning pile assembly for supporting a structure upon the earth comprising:

at least one steel pipe;

a plurality of concrete pile segments positioned above the steel pipe, said plurality of concrete pile segments extending vertically in end-to-end relationship, said plurality of concrete pile segments comprising:

a first concrete pile segment having a hole extending longitudinally therethrough;

a second concrete pile segment having a hole extending longitudinally therethrough; and a strand affixed in the holes of said first and second concrete pile segments; and a transition member interposed between the steel pipe and the concrete pile segments such that the load of the concrete pile segments is supported by the steel pipe.

2. The underpinning pile assembly of claim 1, said at least one steel pipe comprising:

a plurality of steel pipe segments extending in end-to-end relationship in generally vertical alignment.

3. The underpinning pile assembly of claim 2, said plurality of steel pipe segments comprising:

a first steel pipe segment;

a second steel pipe segment; and a key member engaged in said first and second steel pipe segments.

4. The underpinning pile assembly of claim 3, said first steel pipe segment having a slot formed at an end thereof, said second steel pipe segment having a slot formed at an end thereof, said key member received in the slots of said first and second steel pipe segments.

5. The underpinning pile assembly of claim 4, said key member being freely received in the slots of said first and second steel pipe segments such that said end of said first steel pipe segment abuts said end of second steel pipe segment.

6. The underpinning pile assembly of claim 1, said transition member comprising:

a collar receiving the steel pipe therein; and a flange affixed to an end of said collar, one of the concrete pile segments having an end abutting a surface of said flange opposite said collar.

7. The underpinning pile assembly of claim 1, said plurality of concrete pile segments further comprising:

an adhesive received in the holes of the said first and second concrete pile segments so as to fix said strand in each of said first and second concrete pile segments.

8. The underpinning pile assembly of claim 1, each of the concrete pile segments having a length of approximately 12 inches and a diameter of 6 inches, the steel pipe having a length of approximately 12 inches and a diameter less than said diameter of each of the concrete pile segments.

9. An underpinning pile assembly for supporting a structure upon the earth comprising:

a plurality of steel pipe segments extending in end-to-end relationship in generally vertical alignment; and a plurality of concrete pile segments extending vertically in end-to-end relationship, an uppermost steel pipe segment of said plurality of steel pipe segments supporting a lowermost concrete pile segment of said plurality of concrete pile segments thereon, said plurality of concrete pile segments comprising:

a first concrete pile segment having a hole extending longitudinally therethrough;

a second concrete pile segment having a hole extending longitudinally therethrough; and a strand affixed in the holes of said first and second concrete pile segments.

10. The underpinning pile assembly of claim 9, said plurality of steel pipe segments comprising:

a first steel pipe segment;

a second steel pipe segment; and a key member engaged in said first and second steel pipe segments.

11. The underpinning pile assembly of claim 10, said first steel pipe segment having a slot formed at an end thereof, said second steel pipe segment having a slot formed at an end thereof, said key member received in the slots of said first and second steel pipe segments.

12. The underpinning pile assembly of claim 9, further comprising:

a transition member interposed between said plurality of steel pipe segments and said plurality of concrete pile segments such that a load of said plurality of concrete pile segments is supported by said plurality of steel pipe segments.

13. The underpinning pile assembly of claim 12, said transition member comprising:

a collar receiving said uppermost steel pipe segment of said plurality of steel pile segments therein; and a flange affixed to an end of said collar, said lowermost concrete pile segment of said plurality of concrete pile segments having an end abutting a surface of said flange opposite said collar.

14. A process for installing piles for supporting a structure upon the earth comprising:

driving a steel pipe into the earth a desired distance from the structure;

positioning a concrete pile upon an end of said steel pipe; and driving said concrete pile segment into the earth for a desired distance from the structure so as to correspondingly drive the steel pipe further into the earth, the step of driving said concrete pile segment comprising:

affixing a strand in a hole formed in the first concrete pile segment;

sliding a second concrete pile segment along said strand such that an end of said first concrete pile segment abuts an end of said second concrete pile segment; and driving said second concrete pile segment into the earth a desired distance from the structure.

15. The process of claim 14, the step of positioning comprising:

placing a transition member onto said end of the steel pipe; and positioning a lowermost end of said first concrete pile segment against a surface of said transition member.

16. The process of claim 14, the step of driving a steel pipe comprising:

driving a first steel pipe into the earth a desired distance from the structure;

inserting a key member into a slot on an end of said first steel pipe;

inserting said key member into a slot on an end of a second steel pipe; and driving said second steel pipe into the earth a desired distance from the structure so as to correspondingly drive said first steel pipe further into the earth.

* * * * *